United States Patent [19]

Yasuda

[11] Patent Number: 4,820,228

[45] Date of Patent: Apr. 11, 1989

[54] SEALING APPARATUS FOR PICTURE TUBE

[75] Inventor: Koichi Yasuda, Yotsukaido, Japan

[73] Assignee: Hitachi, Ltd., Tokyo, Japan

[21] Appl. No.: 21,644

[22] Filed: Mar. 4, 1987

[30] Foreign Application Priority Data

Mar. 20, 1986 [JP] Japan ..... 61-60536

[51] Int. Cl.[4] ..... H01J 9/26

[52] U.S. Cl. ..... 445/67; 65/155; 445/71

[58] Field of Search ..... 445/67, 70–71; 65/155

[56] References Cited

U.S. PATENT DOCUMENTS 3,594,059 7/1971 Holz ..... 445/67

4,392,601 7/1983 Fujikawa et al. ..... 228/4.1

*Primary Examiner*—Kenneth J. Ramsey

*Attorney, Agent, or Firm*—Antonelli, Terry & Wands

[57] ABSTRACT

A picture tube sealing apparatus for thermally welding a stem structure and a neck portion of a glass bulb thereof to each other and thereby seal the same. A table, on which a plurality of burners formed correspondingly to the diameters of the neck portions of various types of glass bulbs are arranged unitarily so that the burners have a predetermined angle with respect to each other, is turned to move a burners corresponding to the diameter of an object glass bulb to a predetermined position to thereby carry out a burner-switching operation, whereby the heating power of the burner can be regulated without manual operation even when the neck portions of glass bulbs fed sequentially have a plurality of different diameters.

1 Claim, 4 Drawing Sheets

SEALING APPARATUS FOR PICTURE TUBE

BACKGROUND OF THE INVENTION

This invention relates to a sealing apparatus for picture tubes adapted to seal a glass bulb having a phosphor screen on the inner side thereof, and a stem structure having an electron gun structure mounted thereon.

In general, in a step of manufacturing a color picture tube, a phosphor screen, a graphite electrode and a shadow mask are set on the inner side of a glass bulb, and an electron gun structure-mounted stem structure is then sealed to an open end of a neck portion of the glass bulb. Such a sealing operation is disclosed in, for example, Japanese Patent Publication No. 31595/1978. In order to carry out such a picture tube sealing operation, a picture tube sealing apparatus, which will be described in the following paragraph, is used.

FIG. 2 is a construction diagram in plan of a principal portion of an example of a generally-used picture tube sealing apparatus. Referring to the same drawing, a disc type turntable 10 is provided on the outer circumferential portion thereof with a plurality of sealing holders 11, which are adapted to hold this type of glass bulbs concentrically with their tubular shafts, and which are spaced at regular intervals. These sealing holders 11 are turned at a predetermined speed in the direction of an arrow A by an automatic driving unit (not shown in the drawing). The sealing holders 11 are moved accurately to predetermined places at regular time intervals by an index driving unit (not shown in the drawing). On this turntable 10, the mounting and demounting of glass bulbs are done usually in the sealing holders 11 in places #1–#2; the preheating of the neck portions and the portions to be sealed of the glass bulbs, in the sealing holders 11 in places #3–#8; the fusing of the neck portion of the glass bulb, in the sealing holder 11 in a place #9; the melt-separating of the glass bulb, in the sealing holder in a place #10, the gradual cooling of the neck portions of the glass bulbs in the sealing holders in places #11–#15; and then the removing of fragment of the neck tube (usually called cullet glass) in the sealing holder in a place #16, which has been separated from the neck portion of the glass bulb by the melt-separating.

FIG. 3 is a side elevation of a principal portion of the sealing holder 11 illustrated in FIG. 2. Referring to FIG. 3, the sealing holder 11 is adapted to retain firmly in a predetermined reference point a glass bulb 1, in which a phosphor screen, a graphite electrode and a shadow mask etc. are formed, by a bulb holder unit 17 consisting of a bulb stopper 12, a panel chuck 13, a bulb support 14, a holder frame 15 and a bulb holder 16 etc., and supported fixedly on the turntable 10 via a support 18. A mount pin 19 which is provided with a stem structure 3 having an electron gun structure 2 mounted thereon concentrically with a tubular shaft thereof to drive the stem structure 3 in the rotational and vertical directions is joined to the lower portion of this bulb holder unit 17. Reference numeral 1 denotes a glass bulb.

In this arrangement, the stem structure 3 on which the electron gun structure 2 is mounted is roughly regulated and set on the mount pin 19, and then lifted and inserted into the bulb neck portion 1*a*. The mount pin 19 is regulated finely in the rotational and vertical directions to position the electron gun structure 2 to a predetermined height. The part of the outer circumferential surface of the neck portion 1*a* which is opposed to the stem glass 3*a* in the stem structure 3 is then heated with the flames 21 generated by gas burners 20, as shown in FIG. 4, to weld the neck portion 1*a* and stem glass 3*a* to each other as shown by a solid line. The neck portion 1*a* and stem glass 3*a* are thus welded and sealed and simultaneously the cullet glass 1*a*′ is melted and separated from the neck portion 1*a*, which hangs down from the welded portion. The melted and separated cullet glass 1*a*′ is left on a base 19*a* of the mount pin 19. Reference numeral 3*b* denotes an exhaust tube.

There are various types of picture tubes, such as a picture tube in which the outer diameter of a bulb neck portion 1*a* is, for example, 29 mm (which will hereinafter be referred to as a 29 mm neck-carrying picture tube), a 22 mm picture tube (which will hereinafter be referred to as a 22 mm neck-carrying picture tube) and a 38 mm neck-carrying picture tube. The demand ratio of these neck-carrying picture tubes has recently become unstable. Accordingly, for example, a 29 mm neck-carrying picture tube and a 22 mm neck-carrying picture tube have their special sealing apparatus. This sealing apparatus has a satisfactory overall sealing capability but, for example, when the demand ratio of the 29 mm neck-carrying picture tubes and 22 mm neck-carrying picture tubes increases or decreases extremely, the sealing capability of the apparatus becomes low.

To be concrete, this sealing apparatus has a special gas burner 20 shown in FIG. 5. In order to apply a gas burner specially used for a 29 mm neck-carrying picture tube to a 22 mm neck-carrying picture tube, or a gas burner specially used for a 22 mm neck-carrying picture tube to a 29 mm neck-carrying picture tube, the diameter of a flame 21 of the burner 20 is regulated manually so that the flame 21 sufficiently covers the region to be heated of the bulb neck portion 1*a*, in accordance with the different outer diameter thereof to thereby set the heating power to a suitable level. Namely, in order to heat the neck portion 1*a* of the 29 mm neck-carrying picture tube, the diameter of the flame 21 is increased so as to increase the heating power, and, in order to heat the neck portion 1*a* of the 22 mm neck-carrying picture tube, the diameter of the flame 21 is set smaller than that in the case of heating the neck portion 1*a* of 29 mm in diameter, by changing the nozzle of the gas burner 20.

SUMMARY OF THE INVENTION

An object of the present invention is to provide a picture tube sealing apparatus capable of sealing simultaneously by a single sealing apparatus a plurality of random-arrayed picture tubes having bulb neck portions of different outer diameters.

In the picture tube sealing apparatus according to the present invention, a plurality of burners, which have, for example, flames of different diameters corresponding to the bulb neck portions of different diameters of picture tubes, are arranged unitarily so that the burners have a predetermined angle with respect to one another, and a switch means for moving a desired burner to a heating zone so as to be opposed to the neck portion of a certain diameter of an object glass bulb, whereby a heating unit is formed.

According to the present invention thus constructed, the burner is switched to a desired burner in accordance with the diameter of the neck portion of a glass bulb to be heated, while the turntable is moved, and the bulb neck portion is heated by a predetermined burner.

DESCRIPTION OF THE PREFERRED EMBODIMENTS

An embodiment of the present invention will now be described in detail.

Figure 1:
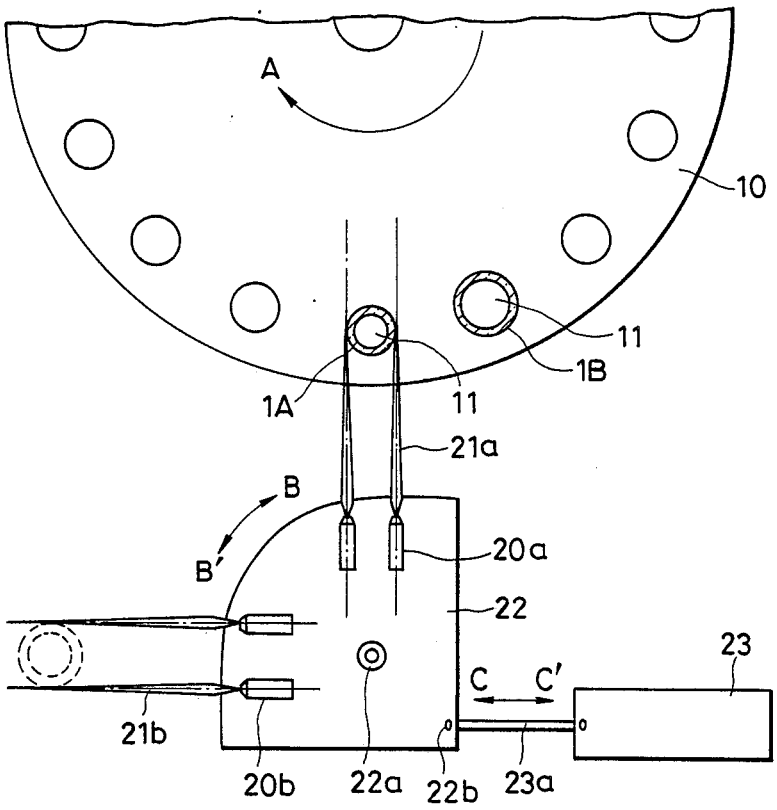
FIG. 1 is a plan view of a principal portion of an embodiment of the picture tube sealing apparatus according to the present invention.
Figure 2:
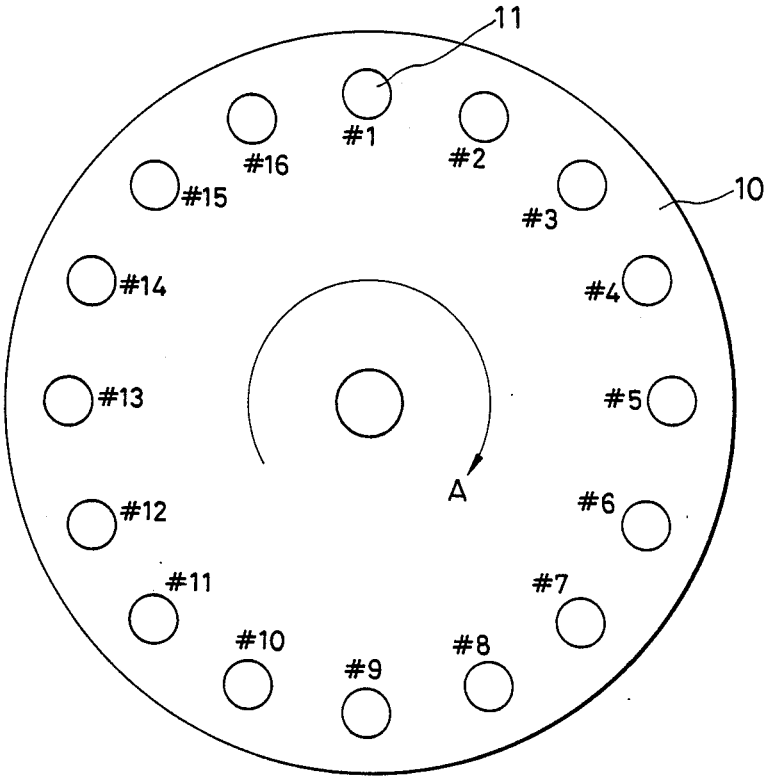
FIG. 2 PRIOR ART
FIG. 2 is a plan view of a conventional picture tube sealing apparatus.
Figure 5:
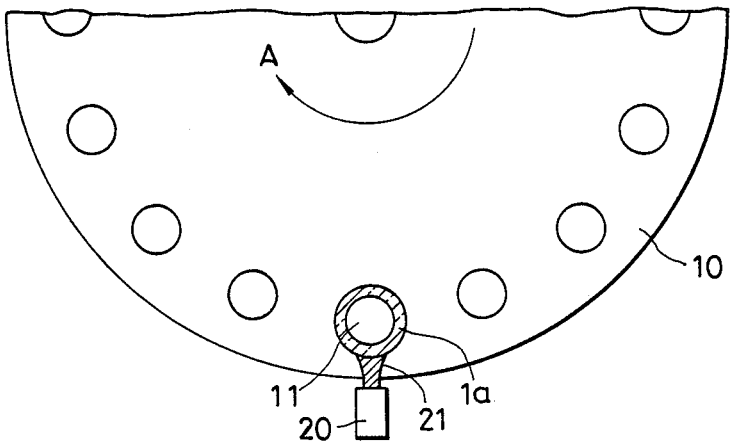
FIG. 5 PRIOR ART
FIG. 5 is a plan view of a conventional picture tube sealing apparatus.
Figure 3:
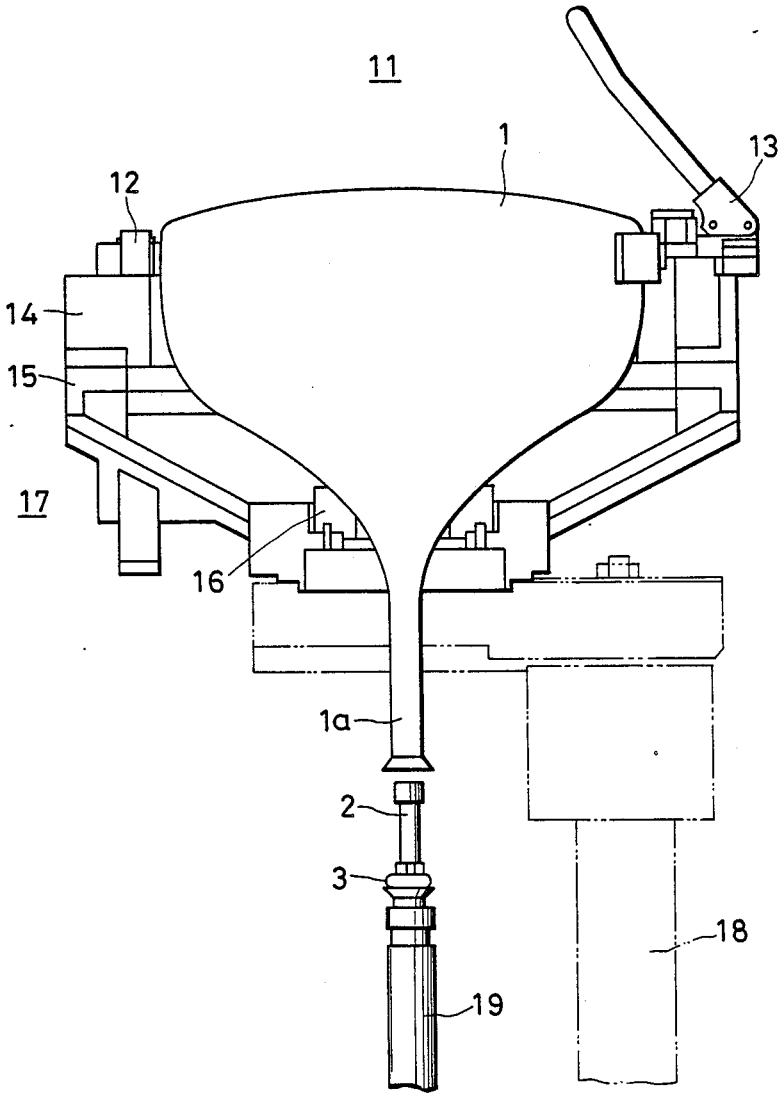
FIG. 3 is a side elevation of a sealing holder.
Figure 4:
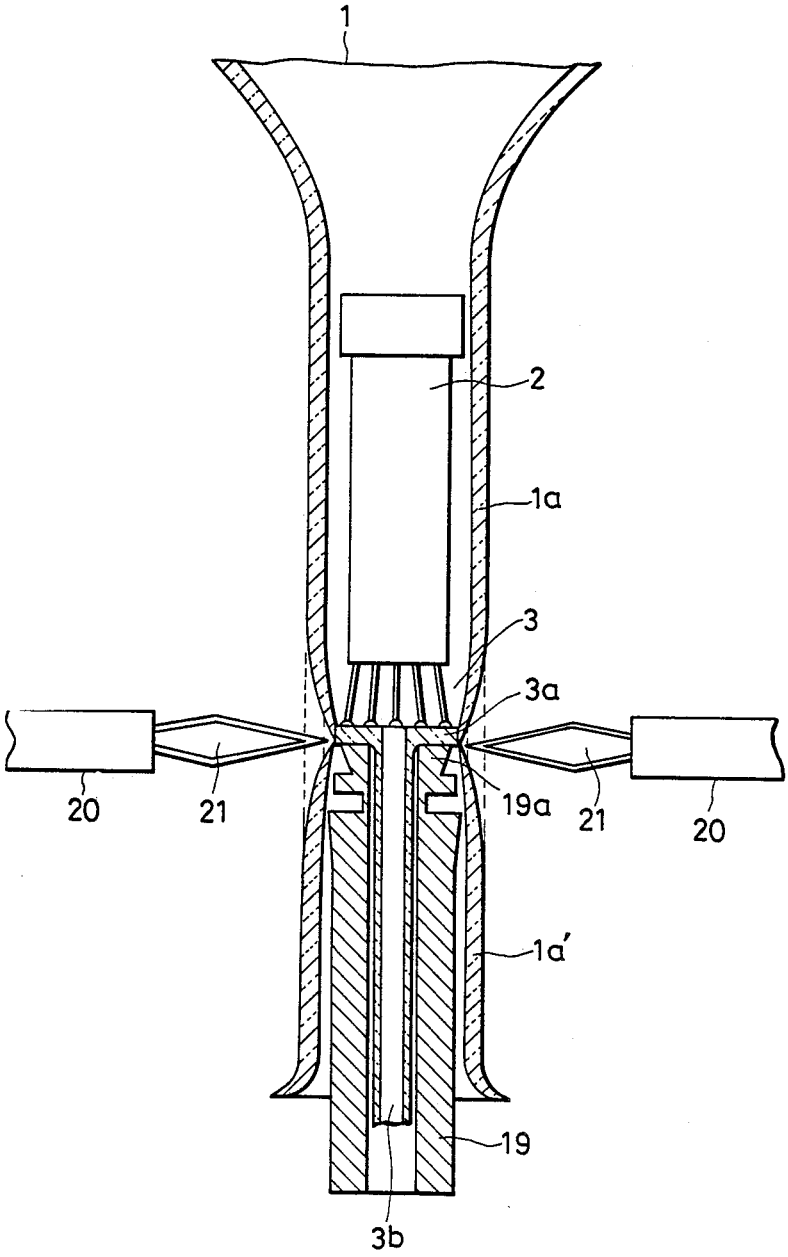
FIG. 4 PRIOR ART
FIG. 4 is a schematic sectional view illustrating the sealing state in the conventional technique.

FIG. 1 is a plan view of a principal portion of the picture tube sealing apparatus of an embodiment according to the present invention, in which the parts identical with those shown in FIGS. 2–4 are designated by the same reference numerals as are used in FIGS. 2–4. Referring to FIG. 1, a heating unit disposed in a working position on the outer side of a turntable 10 is provided with two gas burners **20*b*, which are adapted to generate flames 21*b* thick enough to cover the bulb neck portion of a 29 mm neck-carrying picture tube sufficiently and heat the same, and two gas burners 20*a*, which are adapted to generate flames 21*a* thick enough to cover the bulb neck portion of a 22 mm neck-carrying picture tube sufficiently and heat the same, on both end portions of a small fan-shaped table 22 so that these two pairs of gas burners 20*b*, 20*a* are set thereon fixedly and spaced from each other at 90°. A driving point 22*b* for turning this small table 22 in the directions of an arrow B–B′ is provided in the vicinity of a fulcrum 22*a* of the same table 22, and an air cylinder 23 joined to a shaft 23*a* for moving the driving point 22*b* in the directions of an arrow C–C′ is connected to the same point 22*b***.

In such a structure, the turntable 10 is turned in the direction of an arrow A with 29 mm neck-carrying bulbs and 22 mm neck-carrying bulbs held at random in the sealing holders 11 provided on the turntable 10. In sealing the neck portions of the bulbs, first, when the bulb neck portion 1A of a 22 mm neck-carrying picture tube has reached a working position, the air cylinder 23 is operated to drive its shaft **23*a* in the direction of the arrow C′, so that the small table 22 is turned about 90° around the fulcrum 22*a* in the direction of the arrow B′. The bulb neck portion 1A is then heated with the flames 21*a* of a smaller diameter outputted from the two gas burners 20*a*. When the bulb neck portion 1B of a 29 mm neck-carrying picture tube has then reached the working position, the air cylinder 23 is operated to drive its shaft 23*a* in the direction of the arrow C, so that the small table 22 is turned about 90° in the direction of the arrow B. The bulb neck portion 1B is then heated with the flames 21*b* of a larger diameter outputted from the two gas burners 20*b*. The gas burners 20*a* of a smaller diameters and gas burners 20*b* of a larger diameters are switched by the air cylinder 23 while the turntable 10** is turned one step.

According to the apparatus of such construction, the bulb neck portions 1A, 1B of the 22 mm neck-carrying picture tube and 29 mm neck-carrying picture tube, which are arranged at random on the turntable 10, can be heated at once continuously.

In the above embodiment, the switching of two types of picture tubes, i.e., 29 mm neck-carrying picture tubes and 22 mm neck-carrying picture tubes is described but the present invention is not, of course, limited to this picture tube switching mode. In the same embodiment, flames of different diameters are used but some other heating means may, of course, be used.

According to the present invention described above, a plurality of glass bulbs having bulb neck portions of different diameters can be processed thermally in succession. This enables very good effects to be obtained. Namely, the production tolerance of picture tubes can be improved greatly, and problems occurring due to complicated fluctuations of demand for different types of picture tubes can be solved easily.

What is claimed is:

1. A picture tube sealing apparatus comprising, a plurality of sealing holders for retaining glass bulbs concentrically with tubular shafts thereof, a mount pin holding an electron gun structure which is mounted on a stem structure to be provided in a neck portion of one of said glass bulbs, and a heating unit for heating said stem structure and said neck portion of said one of said glass bulbs so as to weld and seal the same, wherein said heating unit includes a plurality of burner units, each of which has two burners whose flames define a diameter which corresponds to the diameter of said neck portion and which are arranged unitarily and fixedly on a table so that said burner units have a predetermined angle with respect to each other, and switch means for moving a selected one of said burner units in accordance with the diameter of the neck portion of each of said glass bulbs to a position where the flame of said selected one of said burner units can heat said stem structure and said neck portion, said switch means further including means for turning said table so as to move said selected one of said burner units to said position, whereby said sealing holders are operatively arranged accurately to move to predetermined places at regular time intervals sufficient to weld and seal said stem structure and said neck portion so as to successively seal a plurality of picture tubes having neck portions of different diameters.

* * * * *